US005302937A

United States Patent [19]

Leue

[11] Patent Number: 5,302,937

[45] Date of Patent: Apr. 12, 1994

[54] POTENTIOMETER

[75] Inventor: Wolfgang Leue, Abstatt, Fed. Rep. of Germany

[73] Assignee: Horst Siedle KG, Furtwangen, Fed. Rep. of Germany

[21] Appl. No.: 969,135

[22] Filed: Oct. 30, 1992

[30] Foreign Application Priority Data

Nov. 5, 1991 [DE] Fed. Rep. of Germany ..... 4136343

[51] Int. Cl.[5] ..... H01C 10/30; H01C 10/32; H01C 10/10

[52] U.S. Cl. ..... 338/160; 338/75; 338/162; 338/171

[58] Field of Search ..... 338/160, 162, 165, 171, 338/172, 174, 176, 184, 75

[56] References Cited

U.S. PATENT DOCUMENTS 3,652,970 3/1972 Hubert ..... 338/174

4,345,236 8/1982 Eichelberger et al. ..... 338/176

5,155,465 10/1992 Tsuzuki et al. ..... 338/172

*Primary Examiner*—Marvin M. Lateef

*Attorney, Agent, or Firm*—Darby & Darby

[57] ABSTRACT

In connection with a potentiometer, which may in particular serve as actuator element for an electronic accelerator pedal and where a base plate carries the respective resistance and collector path(s), it is proposed that instead of providing the usual metallic inserts in the base plate to serve as sliding surface, at least one additional surface shape be applied on the base plate, preferably by printing, and that this additional shape be applied, preferably printed, on the base plate preferably by the same operation as the resistance and collector paths and using the same or a similar material having good sliding properties, and can then serve as sliding and supporting surface for at least one wiper carrier of the potentiometer.

9 Claims, 1 Drawing Sheet

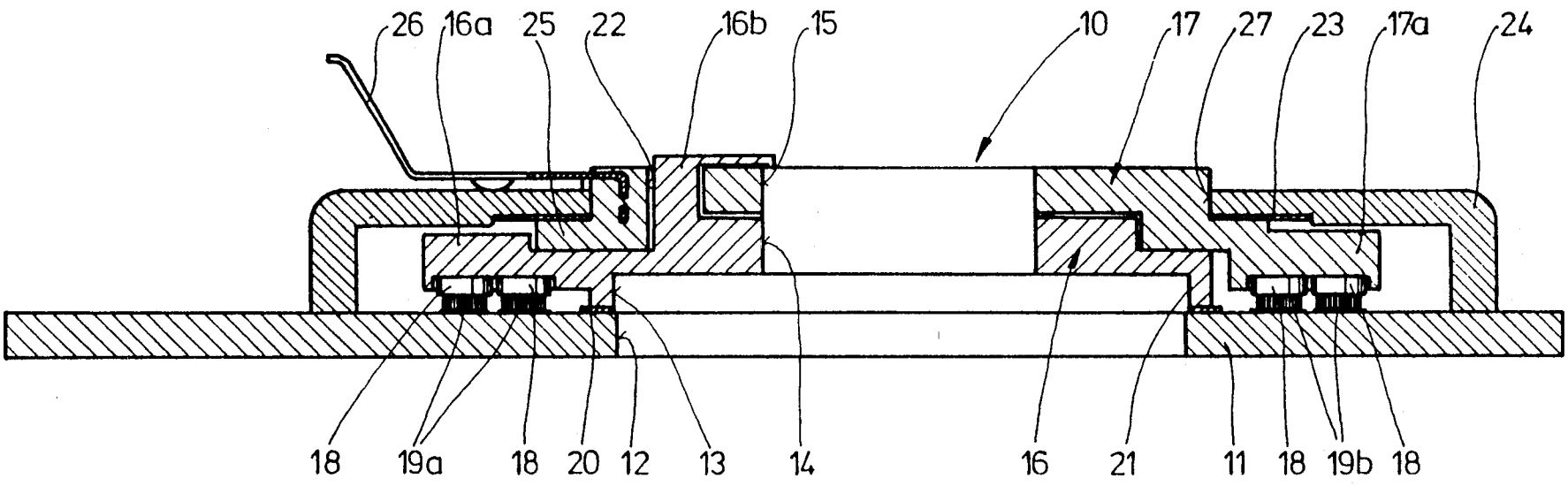
24
17a
23
27
17
10
15
16b
22
25
16a
26
18
19b
18
11
21
16
14
13
12
20
18
19a
18

POTENTIOMETER

DESCRIPTION OF THE PRIOR ART

The present invention relates to a potentiometer according to the preamble of claim 1 and concerns in particular an application related to what is known as electronic accelerator pedal, for example in its idling control.

Potentiometer systems that have been known heretofore in this connection comprise a base plate or substrate upon which the different resistance and/or collector paths are applied by spraying, printing or screen-printing processes so that wipers supported on wiper carriers are in a position to scan these resistance and collector paths. The end portions of the wipers, which are in direct contact with the resistance and the collector paths, may be subdivided in this case into a plurality of separate wiper fingers.

The potentiometers in question usually are rotary potentiometers or translational potentiometers equipped with one or more separate wiper carriers, which are then also moved by separate external drives. These potentiometers may be implemented in many different forms, for example for use only as precision control for the throttle, via a servomotor, while the mechanical transmission between the accelerator pedal and the throttle is maintained with a suitable play so that in any case an emergency driving operation can be maintained will be maintained, even if the electronic system should fail.

In the case of such potentiometer systems, metallic inserts are provided at least in the base plate, which inserts are then arranged already during the production process, for example introduced as core in the injection-molding die, when the base plate is produced by injection-molding methods; or else one deposits metal or similar coatings or galvanic layers, as in the case of circuit boards for example, which layers may later, during operation of the potentiometer system, serve as "circular" sliding bearing for at least one of the wiper carriers. Such a design is complex and may even be connected with the disadvantage of a constant sliding contact between different materials, namely the plastic material of the wiper carrier and the metallic sliding surface, which latter is necessary, however, in order to ensure easy adjustability of the wiper carrier.

Further, it is common practice with these known potentiometer systems to provide metallic connection bridges between the wiper carrier, which performs a rotary movement about a bearing bush, and the different wipers supported by it, and this also makes it necessary to position corresponding inserts in the injection-molding die for each of the wiper carriers.

Now, it is the object of the present invention to configure a potentiometer in such a way that the input required for ensuring and maintaining the capability to slide for at least one of the wiper carriers is reduced decisively, while simultaneously saving material especially in the area of the base plate, and improving the sliding properties quite generally.

ADVANTAGES OF THE INVENTION

The invention achieves this object with the aid of the characterizing features of claim 1 and provides the advantage that it can do without any inserts in the area of the base plate carrying the resistance and collector paths, while it can still provide a supporting or sliding surface meeting all requirements as regards durability and easy sliding, for at least one wiper carrier.

It must be considered in this connection that the wiper carrier, which can rotate on the base plate via a (annular) surface formed by it, rests on that surface at a certain pressure, due to the necessity that the potentiometer system as a whole requires a certain stress in the axial direction so that the wipers supported on the wiper carriers come to slide on the respective resistance paths and collector paths, if such are provided, at constant pressure and spacing. By not only making the sliding surface on the base plate for the at least one wiper carrier from the same material as the resistance and/or collector paths, which anyway have to be applied on the base plate, but applying them on the base plate in one operation together with these paths, in particular—as mentioned before—by spraying, printing, or screen-printing methods, the resulting increase in height—which anyway results from the application of the resistance and collector paths, which usually consist of a suitable conductive plastic material—is very insignificant, the only difference being that an additional (annular) path has to be applied as supporting and sliding surface for the at least one wiper carrier, while on the other hand during production of the base plate no inserts or cores have to be provided at all in the base plate so that the latter can be formed as a simple injection-molded part, easily and without any problems.

It is a further advantage of the present invention that the conductive plastic material used for the resistance and collector paths—the present invention relates especially to such a potentiometer system—provides particularly good surface sliding properties by its very nature, as the conductive plastic materials used for this type of potentiometers, which are also known as mass potentiometers, contain a relatively high content of graphite and are designed a priori for good sliding characteristics, being in constant sliding contact with the wiper fingers of the wipers. Such a supporting and sliding surface consisting of a conductive plastic material, therefore, is also particularly well suited to serve as a sliding-surface support for wiper carriers.

The features specified in the subclaims permit advantageous further developments and improvements of the invention. According to a particularly advantageous embodiment, the wiper carriers have a generally annular shape with integrally molded extensions suited to receive and support the individual wipers for the resistance and collector paths, without the need to provide intermediate inserts.

BRIEF DESCRIPTION OF THE DRAWING

One embodiment of the present invention will be described hereafter in more detail with reference to the drawing which shows a cross-sectional view of a preferred embodiment of a potentiometer system having a base plate carrying the resistance and collector paths, a wiper carrier sliding thereon and a cover, to serve as a component for the implementation of an electronic accelerator pedal.

DESCRIPTION OF THE EMBODIMENTS

It is the basic idea of the present invention to provide on the base plate, which anyway carries resistance and/or collector paths, at least one additional path consisting of the same material and applied by the same operation, or in any way during the same processing operation of the base plate, which path is then not necessarily used for other electric tasks, but is intended only—regarding primarily the main subject-matter of the invention—to provide a sliding surface for the mechanical movements of the potentiometer.

On the other hand, such an additional surface shape may, however, also be assigned additional electric tasks, for example to serve as supply line and/or as resistance path or collector path, in addition to its primary function, namely its function as a sliding surface.

Before going deeper into the details of the preferred embodiment of the invention, it should be noted that the invention is suited for any imaginable configuration of a potentiometer, i.e. not only for rotary potentiometers, but also for translational potentiometers of the type frequently used as displacement sensors, so that by applying an additional sliding surface, comparable with the resistance and/or collector paths and extending in the widest sense in parallel to these two paths, a supporting and sliding surface can be provided also in a linear potentiometer, for other moving parts of the potentiometer.

In the drawing, the potentiometer is designated by reference numeral 10, the potentiometer base by 11. The base plate, which also may be described as substrate, comprises a central opening 12 serving as a passage for a suitable bush which supports and centers the base plate and which, starting from the opening 12, exhibits a stepped design formed by further intermediate openings 13, 14 and 15, to serve as passage for an axis or shaft. Usually, however, the existing wiper carriers are not driven by this shaft, but through external driver means in a manner which will be described in more detail further below.

The structure of the potentiometer 10 is completed by two wiper carriers 16 and 17, which are arranged one above the other in axial direction, which engage each other in a manner to permit relative rotation, and which exhibit a substantially circular basic shape, being stepped on the insides and outsides so as to exhibit different diameters, and being provided each with one radially projecting extension 16*a* and 17*a*, respectively, which latter may also be arranged diametrically opposite each other, carrying on their bottoms wipers 18 which in their turn terminate by wiper fingers.

The wiper fingers slide on resistance paths and, if provided, on collector paths 19*a* and 19*b* extending generally in parallel to the resistance path, the resistance and collector paths 19*a* being covered by the wipers 18 of the first wiper carrier 16, and the resistance and collector paths 19*b* being covered by the wipers 18 of the second wiper carrier 17. It is, therefore, understood that in the case of the embodiment depicted in the drawing the respective collector and resistance paths extend only over part of a circle on the substrate of the base plate 11 carrying them.

In the case of the embodiment illustrated in the drawing, another surface 20 can be seen, arranged concentrically to and internally of the resistance and collector paths, which has been applied on the surface of the base plate 11 in the same manner as the resistance and collector paths 19*a*; 19*b*, consists of the same material as the latter and has been provided on the base plate 11 during the same production process, i.e. more or less simultaneously therewith, and which insofar can be regarded as a path parallel to the resistance and collector paths. However, this sliding surface 20 does not primarily contribute to completing the potentiometer illustrated in the drawing by its electric properties; rather it serves as a supporting and sliding surface, in any case for the first wiper carrier 16 of the illustrated embodiment, which has a marginal edge 21, bent off in downward direction, resting on the supporting and sliding surface 20 thus formed. As mentioned before, it is however also possible to assign to the sliding surface additional electric functions. This is so also because it preferably consists of the same material as the resistance and collector paths.

The rotary movement necessary for displacing the first wiper carrier 16 can be driven from the outside, by engagement of a—preferably integrally formed—extension 16*b* of the first wiper carrier 16 which extends in upward direction through an arc-shaped opening 22 in the second wiper carrier 17.

Consequently, the first wiper carrier 16 has an annular edge, which is bent off in downward direction and which may also form a complete circle, resting by its lower sliding surface on the supporting and sliding surface 20 made from the same conductive plastic material as the resistance and/or collector paths, and is also subjected to corresponding rotation, while the second wiper carrier 17 in its turn is supported, with a view to performing a rotary movement, on stepped annular projections of the first wiper carrier 16 which are engaged by the second wiper carrier 17 with its complementary matching annular projections. In upward direction, the second wiper carrier 17 slides on another sliding and supporting surface 23 of a cover 24, which may be formed either by a metallic annular insert—in the illustrated embodiment a rotary potentiometer—embedded in the cover 24, or which may be formed by a sliding coating identical to the sliding surface 20 on the base plate 12, in which case it would consist of a corresponding sprayed-on conductive plastic material, if this should be regarded as desirable for some reason or other, for example for simplification, improvement of the sliding properties also in upward direction, or the like.

In addition, it would also be possible to apply a separate sliding coating also in the contact-surface area 25, between the two wiper carriers 16 and 17, i.e. where these are in frictional contact. This can be effected, for example, either by providing a metallic insert or by applying a sliding coating corresponding to the sliding coating 20 on the base plate 11. Such an arrangement may be convenient in order to allow the two wiper carriers 16 and 17 to move relative to each other. These aspects need not, however, be described here in more detail, being not part of the subject-matter of the invention.

The drawing further shows an outer actuator element 26 for controlling the independent movement of the second wiper carrier 17, with a cylindrical portion of smaller diameter passing a central opening 27 in the cover 24.

I claim:

1. A potentiometer comprising:

a base plate carrying at least one resistance and/or collector path;

at least one wiper for each of said paths;

at least one wiper carrier mounted on said base plate; and at least one additional path formed on said base plate and engaged by said at least one wiper carrier, said at least one additional path forming a sliding surface for said at least one wiper carrier.

2. A potentiometer according to claim 1, wherein said sliding surface is formed on said base plate during the formation of said at least one resistance and/or collector path, said sliding surface consisting of the same material as said at least one resistance and/or collector path.

3. A potentiometer according to claim 1, wherein said sliding surface is formed by spraying, printing or screen printing, separately from the formation of said at least one resistance and/or collector path.

4. A potentiometer according to claim 1, wherein the potentiometer is designed as a rotary potentiometer having concentric resistance and/or collector paths, and said sliding surface supporting said at least one wiper carrier is arranged concentrically to and inwardly of said resistance and/or collector path.

5. A potentiometer according to claim 1, wherein only a first wiper carrier is in direct contact with said sliding surface by a marginal edge of said first wiper carrier which is bent off in downward direction and which extends at least over part of its periphery, and a second wiper carrier is arranged axially above said first wiper carrier and is supported by said first wiper carrier.

6. A potentiometer according to claim 5, wherein a cover forms a second sliding surface opposite said second wiper carrier.

7. A potentiometer according to claim 6, wherein said second sliding surface is constituted by a metallic insert.

8. A potentiometer according to claim 6, wherein said second sliding surface is constituted by a surface shape corresponding to said at least one resistance and collector path and consisting of the same material.

9. A potentiometer according to claim 5, wherein said first and second wiper carriers support said at least one wiper via three extensions which are formed integrally with the said at least one wiper carrier, and which carry said at least one wiper sliding on said at least one resistance and/or collector path.

* * * * *